US008851184B2

(12) United States Patent
Deslierres et al.

(10) Patent No.: US 8,851,184 B2
(45) **Date of Patent: *Oct. 7, 2014**

(54) PROCESS, DEVICE, AND SYSTEM TO CAP AND SEAL OIL AND GAS IN A RISER PIPE

(71) Applicants: John Mayn Deslierres, Fullerton, CO (US); Maria R. Cabedo-Deslierres, Fullerton, CA (US)

(72) Inventors: John Mayn Deslierres, Fullerton, CO (US); Maria R. Cabedo-Deslierres, Fullerton, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/201,725

(22) Filed: Mar. 7, 2014

(65) Prior Publication Data

US 2014/0182859 A1 Jul. 3, 2014

Related U.S. Application Data

(63) Continuation-in-part of application No. PCT/US2012/064525, filed on Nov. 9, 2012, which is a continuation of application No. 13/373,334, filed on Nov. 10, 2011, now Pat. No. 8,256,538.

(60) Provisional application No. 61/780,127, filed on Mar. 13, 2013.

(51) Int. Cl.

| | |
|---|---|
| ***E21B 7/12*** | (2006.01) |
| ***E21B 34/04*** | (2006.01) |
| ***E21B 33/02*** | (2006.01) |
| ***E21B 17/01*** | (2006.01) |
| ***E21B 34/00*** | (2006.01) |

(52) U.S. Cl.

CPC ..... *E21B 34/04* (2013.01); *E21B 33/02* (2013.01); *E21B 17/01* (2013.01); *E21B 34/00* (2013.01)

USPC ..... 166/363; 166/367; 166/373; 166/386; 166/192

(58) Field of Classification Search

CPC ..... E21B 34/04; E21B 43/0122
USPC ..... 166/363, 367, 373, 386, 192
See application file for complete search history.

(56) References Cited

U.S. PATENT DOCUMENTS

| | | | | |
|---|---|---|---|---|
| 2,204,586 | A * | 6/1940 | Grau | 285/36 |
| 2,570,372 | A | 10/1951 | Parrish | |
| 2,812,025 | A * | 11/1957 | Doherty et al. | 166/207 |
| 3,111,991 | A * | 11/1963 | O'Neal | 166/207 |

(Continued)

FOREIGN PATENT DOCUMENTS

| | | |
|---|---|---|
| EP | 2039969 | 3/2009 |

*Primary Examiner* — Matthew Buck
*Assistant Examiner* — Aaron Lembo
(74) *Attorney, Agent, or Firm* — Eric Karich

(57) ABSTRACT

A containment valve assembly using the upcoming pressures to control the flow of oil/gas through a riser pipe with a stop flow plug positioned within the valve housing that has an outer surface shaped to fit within and against the riser pipe, and an inner socket cavity having a conical nose receiver portion with a relief vent allowing the oil/gas to escape through the valve assembly, when desired. The stop flow plug is shaped to fit within the inner socket cavity and moves between an open position and a closed position, wherein the stop flow plug fits securely against the conical nose receiver portion, sealing the relief vent. At the top of the valve, a nut will lock the stop flow plug to the close out plate for additional stoppage. A second embodiment adds a heavy duty insert to supplement the sealing pressure, when needed. Electronic monitors convey data remotely.

8 Claims, 6 Drawing Sheets

(56) References Cited

U.S. PATENT DOCUMENTS

| | | | | | |
|---|---|---|---|---|---|
| 3,783,887 | A | | 1/1974 | Shoji | |
| 3,926,256 | A | * | 12/1975 | McCall | 166/285 |
| 4,273,372 | A | * | 6/1981 | Sheshtawy | 294/86.15 |
| 4,302,018 | A | * | 11/1981 | Harvey et al. | 277/322 |
| 4,354,554 | A | | 10/1982 | Calhoun et al. | |
| 4,363,606 | A | * | 12/1982 | Kilgore | 417/59 |
| 4,378,838 | A | * | 4/1983 | Ogden et al. | 166/153 |
| 4,510,999 | A | * | 4/1985 | George et al. | 166/297 |
| 4,516,598 | A | | 5/1985 | Stupak | |
| 4,700,782 | A | | 10/1987 | Read | |
| 4,709,900 | A | | 12/1987 | Dyhr | |
| 4,776,399 | A | | 10/1988 | Jacob | |
| 5,014,782 | A | * | 5/1991 | Daspit | 166/120 |
| 5,161,617 | A | | 11/1992 | Marschke | |
| 5,445,224 | A | | 8/1995 | Correaux | |
| 5,833,001 | A | * | 11/1998 | Song et al. | 166/287 |
| 6,134,898 | A | * | 10/2000 | Umemura et al. | 62/193 |
| 6,431,273 | B1 | * | 8/2002 | McGarian et al. | 166/183 |
| 6,595,289 | B2 | * | 7/2003 | Tumlin et al. | 166/286 |
| 6,595,297 | B2 | * | 7/2003 | Dallas | 166/382 |
| 6,926,080 | B2 | | 8/2005 | Khomynets | |
| 7,090,033 | B2 | * | 8/2006 | Chan et al. | 175/25 |
| 7,380,603 | B2 | * | 6/2008 | Jeffrey et al. | 166/285 |
| 7,506,686 | B2 | * | 3/2009 | Szarka | 166/192 |
| 7,673,688 | B1 | * | 3/2010 | Jones et al. | 166/311 |
| 7,841,410 | B2 | * | 11/2010 | Barbee | 166/291 |
| 8,240,388 | B2 | * | 8/2012 | Brite | 166/345 |
| 8,251,150 | B2 | | 8/2012 | Ross | |
| 2003/0075361 | A1 | | 4/2003 | Eppink | |
| 2005/0034875 | A1 | | 2/2005 | McLaughlin | |
| 2009/0126798 | A1 | | 5/2009 | Mather | |
| 2010/0294486 | A1 | * | 11/2010 | Pallini et al. | 166/206 |
| 2014/0069659 | A1 | * | 3/2014 | Wang et al. | 166/373 |

* cited by examiner

PROCESS, DEVICE, AND SYSTEM TO CAP AND SEAL OIL AND GAS IN A RISER PIPE

CROSS-REFERENCE TO RELATED APPLICATIONS

This application for a utility patent claims the benefit of U.S. Provisional Application No. 61/780,127, filed Mar. 13, 2013. This application also claims priority to pending PCT application PCT/US12/64525, filed Nov. 9, 2012, which claims priority to U.S. application Ser. No. 13/373,334, filed, Nov. 10, 2011, now U.S. Pat. No. 8,256,538.

FIELD OF THE INVENTION

This invention relates to the inshore monitoring and control of oil/gas from new and/or existing wells previously drilled, or in the recoverable mode, including when the cracking or fracking systems are used, mainly when intense pressures are encountered. The inventors have previously been granted on Sep. 12, 2012 U.S. Pat. No. 8,256,538 B1 for "CONTAINMENT SYSTEM FOR OIL FIELD RISER PIPES" specifically for offshore programs, to avoid oil spilling to the oceans and gas spreading to the environment from platforms or drill ships. Both the above referred to patent and the present patent application apply a new technology of utilizing the available intense pressures encountered, instead of fighting them, to stop the flow of oil and gas coming up to the surface from the wells, and both use an electronic monitor to remotely receive data and control the operations.

BACKGROUND OF THE INVENTION

When a newly drilled well or an old well is opened up on land, the oil/gas under pressure is driven to the surface and causes environmental problems if not stopped. This invention provides a means to stop and control the pressure encountered, and using a special new conception, the leak paths will be temporarily or definitively sealed up with the help of seal monitoring systems remotely controlled at the surface.

The present invention accepts the fact that there is unknown volumes and quantities of pressure encountered when drilling, and the sealing capping function there must be acknowledged and worked with, so that the flow can be captured and stopped. Since the pressure is there, then the solution of the problem should not be the approach used nowadays, that is, to fight it. Instead, such technique is reversed and that pressure is used to help the capping process.

The drill string tool operation can lower the containment valve and close out the flow with the valve, from above. In short, we are closing the well by plugging the well flow, with the well own pressure. In order to achieve more sources of oil and gas, the oil industry has found it possible to additionally retrieve the oil/gas from dry land through a new process called fracking where they drill down through the deep earth into stratus containing oil and gas shale and with explosive technology they crack the shale to retrieve the immense quantities of oil/gas captured there. Oil and gas retrieved in this manner come to the surface with intense pressure from the fracking process and the inherit pressure released from the shale encompasses the oil/gas.

It has been determined that in the continental area of the United States there is more than one hundred years of oil and gas available. To retrieve this store house of energy will require hundreds of exploratory sites for drilling well holes in the earth and with the fracking process the industry will have to pipe the pressured oil/gas to the surface in risers or casement tubes. Each of these wells contains oil and gas captured in the high pressure drilling process. It is very difficult to control this high pressure oil and gas as it seeks out small leak pads between structural members and cracks, and separated structural joints of well components.

It only takes a small opening or gap to propagate into high pressure escape route to create future problems and risks for both the well and its operators. There is a need for a method or a technologic improvement to close down, or metering down by electronically or otherwise monitoring the desired escape routes to the surface for these gases that are encountered when opening up a new well or closing down a previously drilled well.

In a recently reported study it was revealed that there are many companies, of all sizes, searching and drilling for oil and gas. However, due to either economic constraints or limited outdated know-how and/or equipment, the wells that are being activated have encountered leak problems that have not been duly and effectively controlled and stopped. High pressure gases that they have been coping with are indeed difficult to confine and control. Because of these conditions, and having in mind the high costs and risks that have been encountered, there is an extreme need to face and effectively avoid this reality. Considering the thousands of the previously drilled wells around the world, there is a dire need for a new method and positive solution for applying a corrective action for the problem of leakage of oil. This invention presents a method for stopping such leaks in a cost effective way to avoid the problem for either newly drilled or previously drilled wells. This invention also provides a stop flow method for control of oil and gas flow to the surface, and an electronic remotely monitored process for controlling these fine line structural leak paths that grow too large, costly, damaging well crisis which crop up in the news and destroy the confidence of the public and of environmentalists. Even in the cases of wells that have been plugged up before, and there is a need to reopen and reactivate them, or when wells show either permanent or eventual low leakage, or not extreme pressures, the second embodiment of the present valve will be a solution to cope with these conditions as a heavy-duty doughnut-shaped expandable insert can optionally be added to the valve to work in such way that will compensate for the insufficient oil/gas pressures encountered, by inducing a stoppage component.

SUMMARY OF THE INVENTION

The invention is a containment valve assembly for controlling flow of oil/gas under pressure, through a riser pipe. The containment valve assembly includes a valve housing and a stop flow plug positioning within the valve housing. The valve housing has an outer surface shaped to fit within and against the riser pipe, and an inner socket cavity having a conical nose receiver portion. At least one relief vent through the conical nose receiver portion of the valve housing, for allowing the oil/gas to escape through the containment valve assembly. The stop flow plug is shaped to fit within the inner socket cavity, and is capable of moving between an open position wherein that the oil/gas can flow past the stop flow plug and through the at least one relief vent, and a closed position wherein a conical nose of the stop flow plug fits securely against the conical nose receiver portion of the valve housing to seal the at least one relief vent and prevent the oil/gas from flowing through the valve assembly.

In one embodiment, the valve assembly includes an electronic component that senses the pressure, the amount, density and temperature of the flow of oil/gas.

In one embodiment, the valve assembly includes a seal means that encircles the valve assembly to prevent leakage of oil past the valve assembly.

In one embodiment, the valve assembly includes a heavy duty doughnut shaped expandable insert for use of the valve assembly in lower pressure wells.

The object of this invention is to provide an urgent means for stopping and capping oil/gas escaping uncontrollably up a riser tube in onshore extraction and providing a means to inhibit the tremendous loss of valuable products and its damage to the environment when other capping procedures have failed, burning to the atmosphere the excess of gas and spreading the oil that escapes from the wells. At the same time, this invention provides a new conception to stop possible leak paths sealing them up either temporarily or definitively, as desired.

DETAILED DESCRIPTION OF THE INVENTION

The present invention provides a valve assembly (21) that is used to stop the flow of oil and gas up a riser (20) or casement tube (e.g., in a drilled well in dry land). The valve assembly (21) utilizes the pressure of the oil/gas coming up a riser (20) to close the valve assembly (21), instead of employing the traditional approach which requires fighting against such pressure. The stop flow plug is driven into closure position by that pressure and stops the flow of the oil/gas.

As the well is drilled, casement tubes are inserted into the drilled well to contain the earth and cut debris. As the well goes deeper and deeper, closeout casement tubes are progressively inserted and attached to each other to line the well and to contain the well wall. This invention provides the means for stoppage of all flow of oil/gas coming up the riser and containment tubes of newly drilled and previously drilled wells on land, by using the available intense pressures encountered. After loosening the nut, the operator will monitor by electronic remote control the engagement or disengagement of the drill string tool to the probe, thus controlling the closing of the flow by pulling up on the probe, or opening the system in order to start the flow by pushing the probe down to activate the oil well, either way according to the circumstances. At the moment to leave the well, the operator will use the remote control to check the conditions in the valve and thru the valve, and all data is electronically transmitted. The plug driven by the intense pressure in the well, closes the valve and stops all flow. This feature completely eliminates the expensive need for pumping concrete down into the well to stop the flow. In addition, the invention contains a seal means that encircles the valve, providing for sealing fine line leak paths between the riser and the valve. There is a closeout plate on the top of the valve as an additional optional redundant method for complete stoppage of the oil/gas through the valve by the use of a nut that is screwed down tightly and cinches up the stop flow plug to firmly lock the plug against the closeout plate at the top of the valve. In case the well has been previously closed up and needs to be reopen, or the pressures encountered are low in a new well, an heavy-duty doughnut-shaped expandable insert will be added to the interior circular base of the valve assembly to increase the sealing pressure needed to entirely stop leakage, if necessary.

Figure 1:
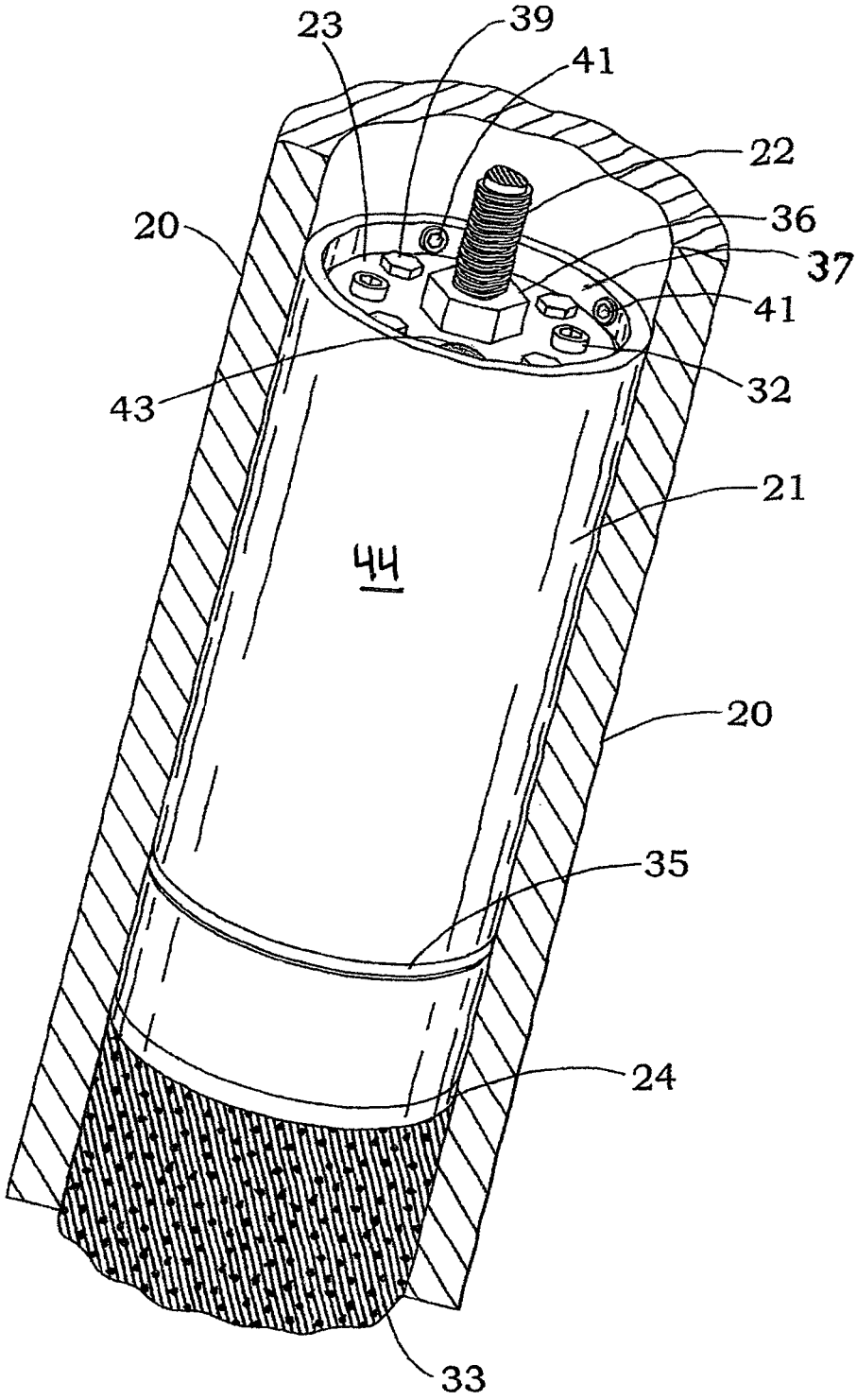
FIG. 1 is a perspective view of a valve assembly seated in a riser.
Figure 2:
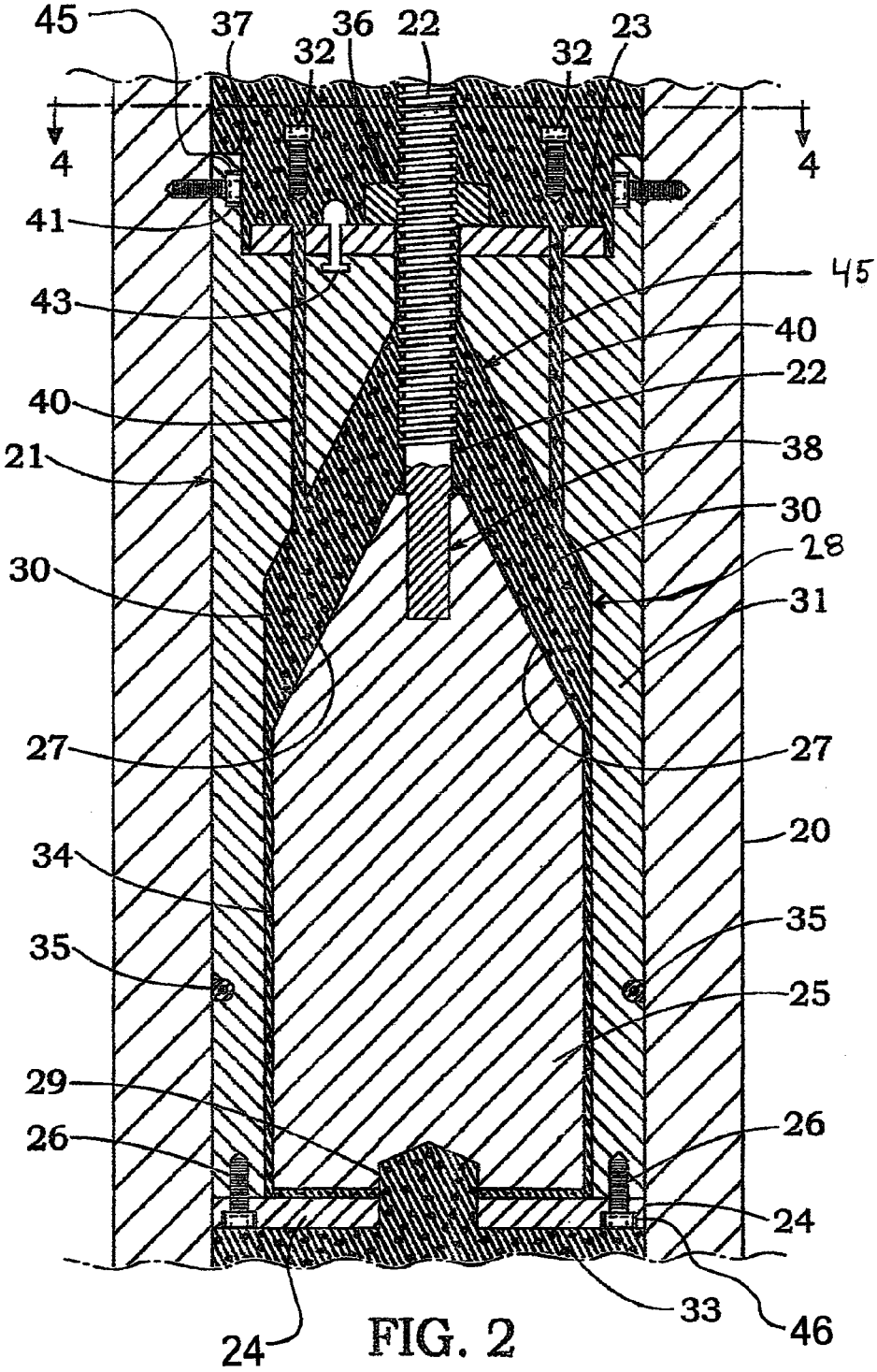
FIG. 2 is a sectional view thereof illustrating the stop flow plug in an open position.
Figure 3:
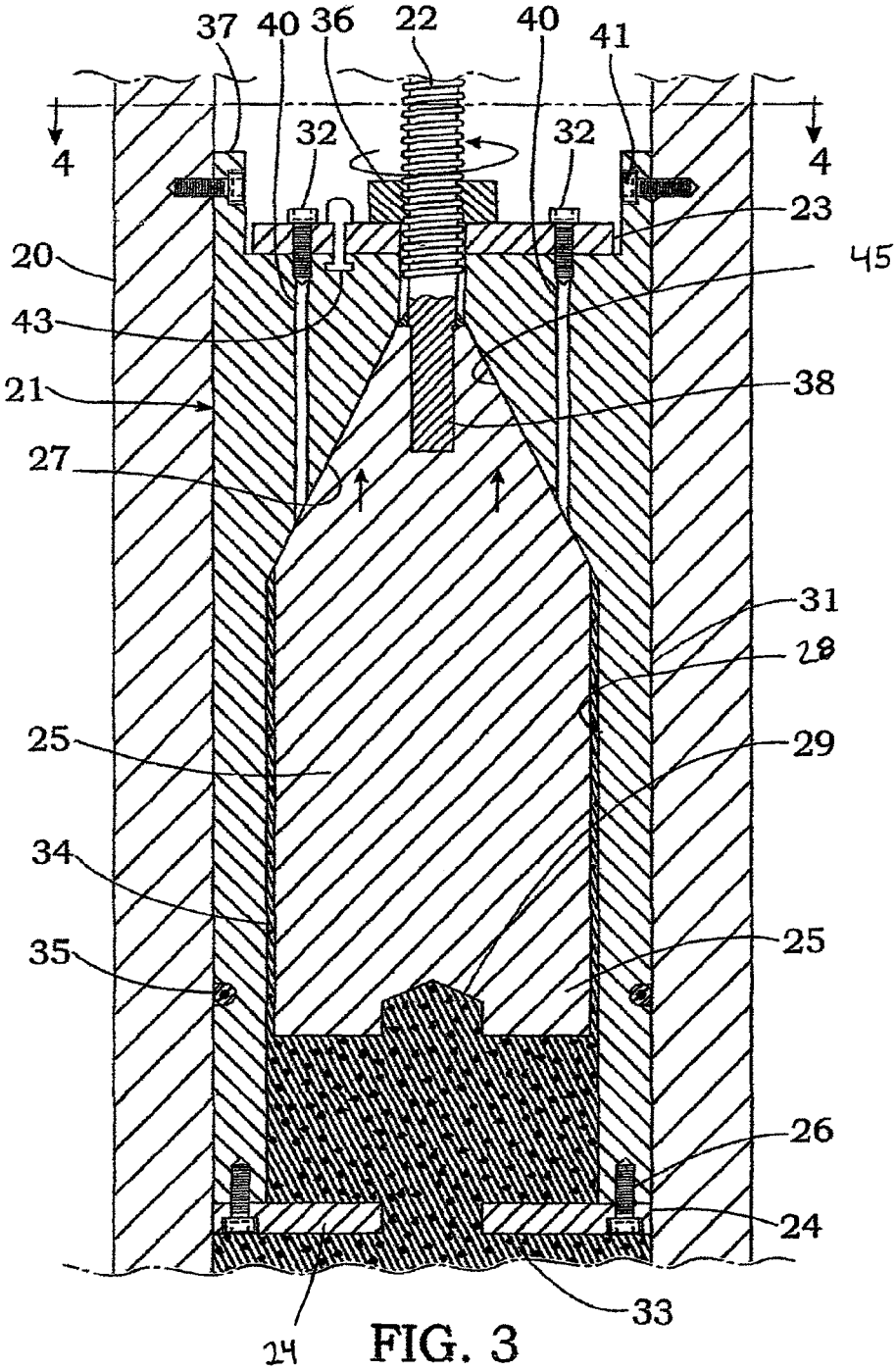
FIG. 3 is a sectional view of the valve assembly illustrating the stop flow plug in a closed position.

FIG. 1 is a perspective view of a valve assembly (21) seated in a riser (20). FIG. 2 is a sectional view thereof illustrating the stop flow plug (25) in the open position. FIG. 3 is a sectional view of the valve assembly illustrating the stop flow plug (25) in the closed position.

As shown in FIG. 1, the valve assembly (21) is at the top of a riser (20) or containment tube (20), with a vertical plunger or probe (22) threaded and extended upwards the upper close-out plate (23) and retained by a large retention nut (36). The valve upper sidewall extension (37) may be attached with screws (41), through pilot holes, to the riser (21). There may be additional screws (39) retaining the upper close-out plate (23) to the structure of the valve. Cap screws (32) may be used to seal relief vents, and the sealed cover of the electronic component (43). The annular lower base plate (24), may have a riser seal (35) that encircles the valve in a provided retention cavity for the purpose of stopping possible oil/gas flow escaping up the outside surface of the valve. Between the interior wall of the riser and the exterior wall of the stop flow plug (25), there may be an outer diameter that leaves a passage (34) through which oil/gas may flow from the bottom of the stop flow plug (25) to the top of the stop flow plug (25).

As shown in FIG. 2 the valve assembly (21), using the attachment screws (39) of the upper sidewall extensions (37) is attached to the riser (20). The stop flow plug is shown in in the open position allowing oil/gas (30) to flow up to the surface through the riser (20). The upper close-out plate (23), the electronic component (43), two relief vents (40) and their cap screws (32), a threaded vertical plunger (22), and its large retention nut (36), the weld (38), may be present in the valve assembly (21). The stop flow plug (25) may have the conical nose (27) shaped to match the conical shape of the socket cavity (28). The lower portion of the valve assembly (21) may have a stop flow plug hex cavity (29), the annular lower base plate (24), bolts (26) fit through threaded holes (46) to attach the annular lower base plate (24) to the valve housing (26). The valve assembly (21) may be seated in a well (33) for up flowing of oil/gas, and also have a riser seal (35) that encircles the valve assembly (21) existing between an outer surface (44) of the valve assembly (21) and the inside surface of the riser (20). The term "conical" is hereby defined to include any form of conical shape, and/or any other form of tapered shape, or equivalent shape that may be designed by those skilled in the art for the function described herein.

As shown in FIG. 3, the valve assembly (21) with its upper sidewall extensions (37) may be attached through drilled pilot holes (41) to the riser (20), with the stop flow plug (25) moved to the closure location, and the relief vents (40) fully closed with cap screws (32). The plug with its conical shape (27) mates with the socket cavity of the valve (28) and is forced to seal tightly within the cavity by the pressure of the rising oil. To ensure that the close-out plug, or stop flow plug firmly seals, the vertical plunger (22) on the upper end of the plug is extended up through the upper close-out plate (23) in the valve, and a retention nut (36) threaded down on the close-out plate ensures complete stoppage of the flow coming up the riser. The riser seal (35) that encircles the valve impedes any intense pressure leak paths.

The valve assembly (21) of this invention, (FIG. 1) which may be cylindrical in shape to match the inside surface of the riser, is held by the operator with the drill string tool. Holding the valve, it may be operated in a closure position, or in an open position, as desired. To initiate the closure of the valve, the operator, while holding the valve by the extended probe, also holds the drill string tool to allow the oil coming up the well to move the stop flow plug into closure position. The oil coming from the well will then be stopped (FIG. 3). The cap screws at the top of the valve can now be attached to the top of the riser as there is no oil coming up. To ensure that the stoppage of the flow will hold, the operator tightens up the large nut on the probe which cinches up the stop flow plug into its full closure position. In the recently adopted method of fracking, when the well operators enter the shale strata in the place where they wish to set the explosive charge, they generally have inserted an interior riser in the assembly to use it for containment of the oil/gas to the surface. Prior to the initiation of the fracking process, and before the operators set the explosive charge off in the strata of shale, the stop flow plug object of this invention should be installed using the drill string tool because the oil/gas under intense pressure would otherwise be driven to the surface thru the riser tube.

The drill string operator attaches the valve upper wall extension projecting surface (37) to the riser tube (20) with fasteners (41) (e.g., bolts, screws, etc.) through the pilot holes (45) provided, and that ensures the firm position of the valve housing within the riser. The valve contains within its internal shape a stop flow plug (25) that has a conical shape nose (27) to mate with the cavity socket in the valve (28) and that is driven to the stop flow condition by the intense escaping pressure that forces the stop flow plug to seal tightly within its retention socket cavity. This intense pressure seals the plug firmly in the valve and contains the flow of oil/gas. Additionally, to ensure that the close out plug seals, a vertical probe or plunger, threaded (22) and welded to the upper end of the stop flow plug, is extended up, through the upper close-out plate (23) in the valve, and a large retention nut (36) is threaded down on the close-out plate to ensure complete stoppage of the flow coming up through the valve.

The complete closure, as illustrated in FIG. 3, may be performed by the operator at the surface either mechanically, or electronically by remote control, using the drill string tool with the valve attached to it, to activate the probe of the valve, and to pull it up tight against the conical cavity existing in the valve so that the flow is firmly restrained and providing visual inspection capability of the complete closure function.

Figure 4:
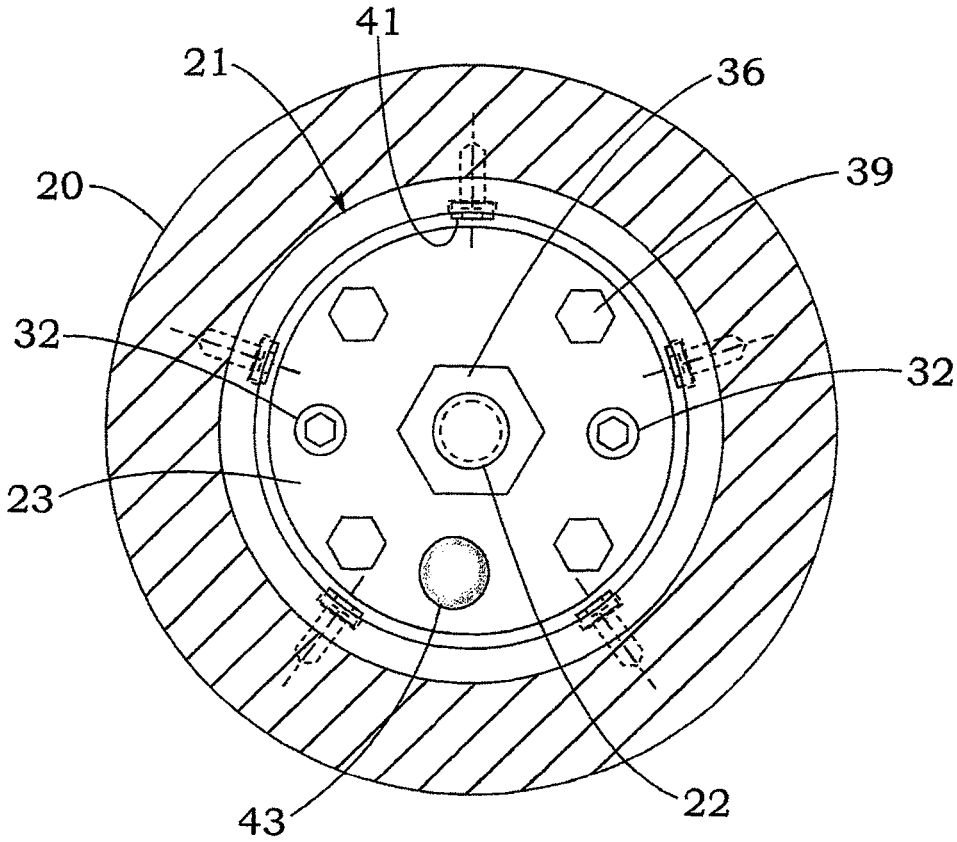
FIG. 4 is a top plan view of the valve assembly.

FIG. 4 is a top plan view of the valve assembly. FIG. 4 shows the upper closeout plate (23) of the valve (21) as it is attached to the riser (20) and the bolting pattern for the connection of the valve into the riser (41), screws (39) to retain the upper plate to the structure of the valve, and cap screws (32) that plug bleed holes of the relief vents (40) for management of oil/gas flow through the valve, and the cover of the electronic component (43). A large retention nut (36) retains the top of the probe or plunger (22) on the oil/gas stop flow plug.

The operator has the means to re-open up the well by using a drill string tool to come down and apply load at the end of the probe or plunger (22) which is on top of the valve (FIG. 4) allowing the retention nut to be unscrewed, and as the said nut is unscrewed, the plunger is pushed down with the drill string tool, or equivalent equipment, and allows the oil/gas to flow up the riser again, ready for storage. There are vent passages (40) (FIG. 3), preferably two, that terminate at the upper close-out plate (23), on the top of the valve, that are sealed by cap screws (32). These vent passages are automatically sealed closed when the stop flow plug moves into closure position. The stop flow plug has a stop flow position and the retention nut (36), screwed down tight against the upper close-out plate, ensures that the relief vent passages (40) are fully stopped, and it shows no flow of the gas and oil through the valve to the surface. At the upper closeout plate, there are provisions for installing testing instruments that either mechanically, or electronically actuated by remote control, can read and detect from the interior of the valve all pertinent data such as the pressures, temperatures, volume and composition of the flow of oil and gas. At the bottom exterior surface of the valve there is an optional electronic read out of data to evaluate the conditions inside the well. The stop flow plug contains at its base a hex cavity (29) for assembly purposes of the valve at manufacturing. This stop flow plug also has in its sealing features a condition to stop leaks in fine line leak paths. This is done with a riser seal (35) encircles the valve in a provided retention cavity for the purpose of stopping any oil/gas escaping up the outside surface of the valve, between the interior wall of the riser (20) and the exterior wall of the valve.

Figure 5:
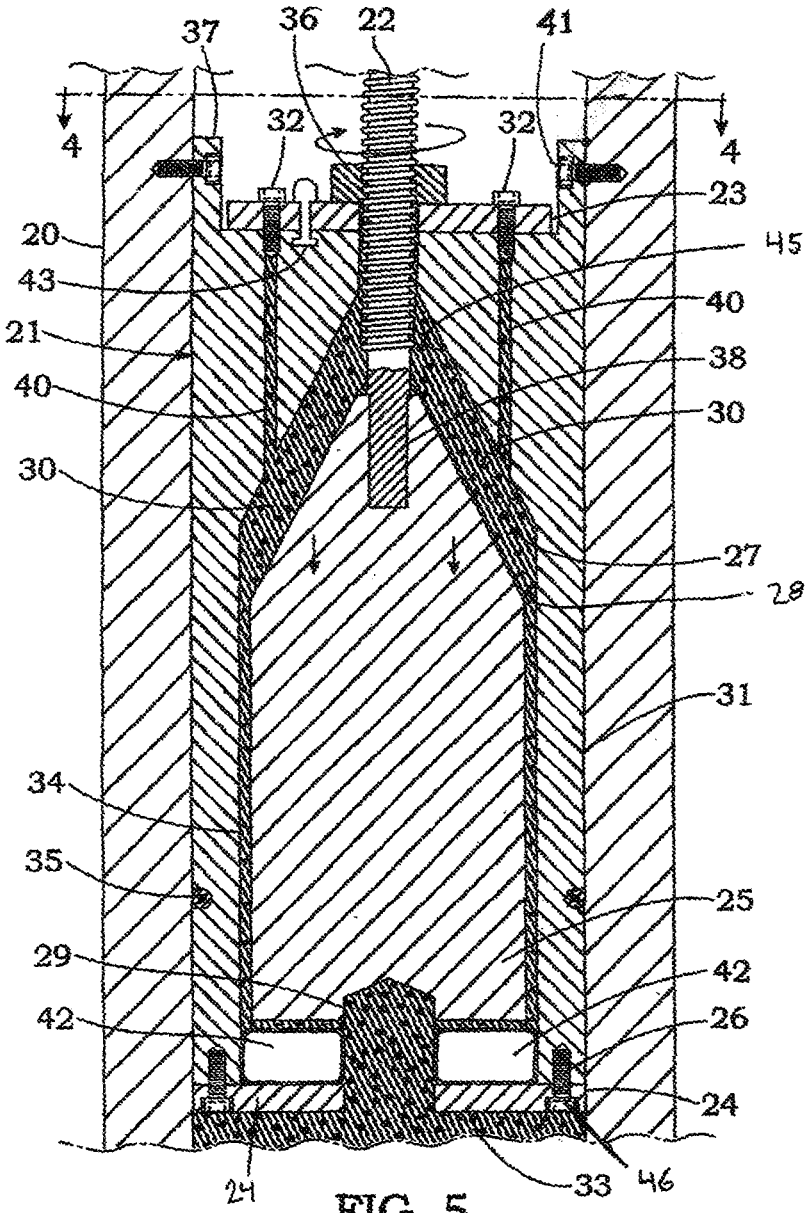
FIG. 5 is a sectional view of a second embodiment of the valve assembly illustrating a heavy duty doughnut shaped expandable insert in an unexpanded condition.
Figure 6:
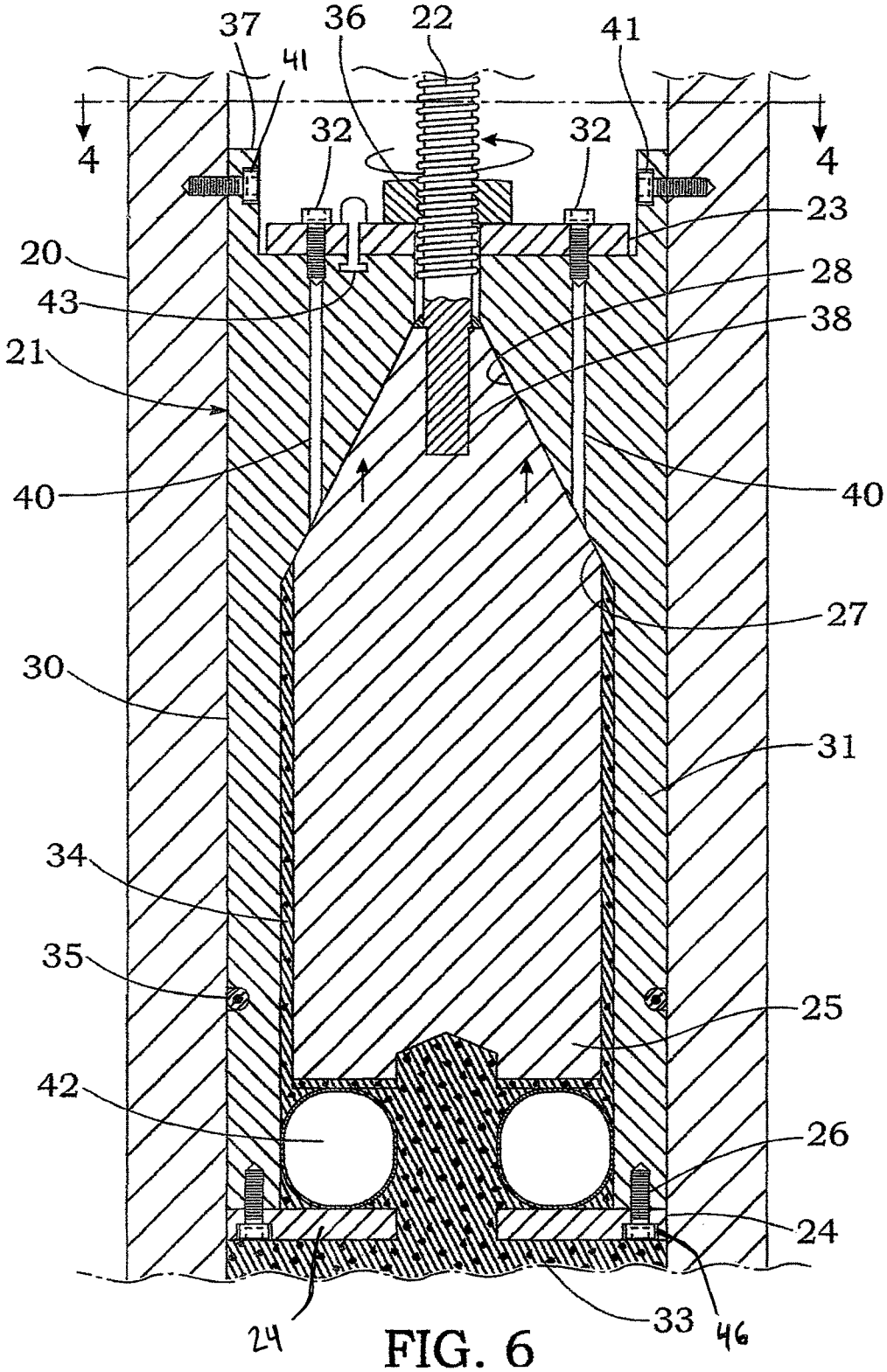
FIG. 6 is a sectional view of the second embodiment of the valve assembly illustrating the heavy duty doughnut shaped expandable insert in an expanded condition.

FIG. 5 is a sectional view of a second embodiment of the valve assembly illustrating a heavy-duty doughnut-shaped expandable insert in an unexpanded condition. FIG. 6 is a sectional view of the second embodiment of the valve assembly illustrating the heavy duty doughnut shaped expandable insert in an expanded condition.

As shown in FIG. 5, one embodiment of the valve assembly further includes the heavy-duty doughnut-shaped expandable insert (42) (i.e., an annular expandable insert), which may be optionally added to the valve assembly when dealing with well, to stop the flow by using the pressure coming from the well, even if the pressure from the well is low. The insert is an expandable doughnut shaped unit, with a hole in the middle, that will expand as necessary to permit pressure to be applied to the base of the stop flow plug (25) to drive it upward to the stop flow closure position, if desired, in order to allow oil/gas to pass upwards through the valve. The insert also applies pressure against the lower annular base plate (24). In cross section view, the stop flow plug (25) is shown in open, down position inside the valve (21) as oil/gas is passing through the passages (34) and the relief vents (40). The heavy duty insert (50) is captured in this location by the inside wall of the valve's cylindrical housing (31) while imposing upward force on the base surface of the plug (25), and a downward force on the annular lower base plate (24), which is attached with screws (26) to the inner surface of the valve's housing (31), and in the compressed condition, ensures that it is guided by this inner surface of the valve's housing and ready to force the plug to its oil/gas closure location, by the drill string operator.

FIG. 6 shows the valve with the heavy-duty doughnut-shaped expandable insert (42) expanded in case the well pressure is low. The stop flow plug (25) is in the closure position to stop oil flow through the valve. A cross section view of the valve with the heavy-duty doughnut-shaped expandable insert (42) shows its shape when expanded for upward force on the base of the stop flow plug (25) in order to supplement the pressure to move the valve into closure on the oil/gas flow though the valve assembly (21) The attachment of the annular lower base plate (24) provides a means for installation and assembly of the heavy-duty doughnut-shaped expandable insert into the valve's enclosed cavity for the same. The heavy duty doughnut insert ensures that there will be enough force in the well to move the plug into closure and complete stoppage of leakage of oil/gas through the valve.

A second embodiment of the present invention is presented considering the multitude of wells that have been drilled in search of new oil and gas sites, and the diverse conditions encountered mainly in terms of magnitude of the oil/gas pressures. Many of the wells show intense pressure, while others show little or no pressure, and a third group show both conditions alternatively. All such wells can leak oil/gas to the surface if not capped correctly, creating adverse environmental crises and major expenses to correct the derivative problems. Under these circumstances, the inventors believe that it is necessary to consider and cope with all three conditions of the oil wells.

This second embodiment of the present invention has the capability to address the leaking problem independent of the intensity of the pressure encountered in all types of wells, from newly drilled ones to the previously drilled, but not correctly capped on on-shore wells. The main concern of the oil industry has been concentrated on leakage in the wells showing intense oil/gas pressures to avoid big disasters. In the first embodiment of the present invention, it was addressed the intense pressures problem to seal leaks in the most common wells on shore, which are the ones showing that condition. This second embodiment of the present invention, comprises, in addition, a new improvement to be used in those wells showing low insufficient pressures. The heavy-duty doughnut-shaped expandable insert (42) with a hole in the middle to allow the oil pass through, is installed captured in its own cavity and in the compressed state inside the valve, FIG. 5, will let the oil/gas passing up through the passages (34) and the relief vents (40) to the surface. When the insert is expanded it will apply pressure against the annular lower base plate (24) of the valve assembly (21) which is attached with screws (26) to the side wall of the valve's housing, and at the same time, the insert is pressing upward against the base of the stop flow plug (25) to supplement the pressure and force the stop flow plug to move to complete closure position, as shown in FIG. 6.

The drill string operator controls the flow and stoppage of the oil/gas when dealing with wells without the extreme pressures that are normally encountered. With the help of said insert, the flow is stopped with the additional pressure obtained, even when the pressure from the well is low. Thus, the basis of the present invention, that is—to use the coming up pressure of oil/gas from the wells, instead of the traditional method of fighting it—is retained in this embodiment with the use of a simple mechanical means that provides capability to replace the insufficient upcoming oil/gas pressure impulse to drive the stop flow plug (25) to plug any leaks, providing full confidence on the closure of the oil/gas flow from the well under any condition.

We claim:

1. A containment valve assembly for controlling flow of oil/gas under pressure, through a riser pipe, the containment valve assembly comprising;

a valve housing having an outer surface shaped to fit within and against the riser pipe, and an inner socket cavity having a conical nose receiver portion;

at least one relief vent through the conical nose receiver portion of the valve housing, for allowing the oil/gas to escape through the containment valve assembly when needed;

a stop flow plug shaped to fit within the inner socket cavity, the stop flow plug being capable of moving between an open position wherein the oil/gas can flow past the stop flow plug and through the at least one relief vent, and a closed position wherein a conical nose of the stop flow plug fits securely against the conical nose receiver portion of the valve housing to seal the at least one relief vent and prevent the oil/gas from flowing through the valve assembly, and wherein the stop flow plug is driven to closure against the conical nose receiver portion by the pressure of the oil/gas up the riser pipe; and a plunger that extends from the stop flow plug, through a guide hole, for moving the stop flow plug between the open and closed positions.

2. The containment valve assembly of claim 1, further comprising:

a lower annular base plate with threaded holes for bolts, the lower annular base plate being bolted to the valve housing with bolts through the threaded holes of the lower annular base plate.

3. The containment valve assembly of claim 1, further comprising: an upper sidewall extension that encircles the valve housing structure, with a series of pilot holes to attach the valve housing structure to the riser pipe in order to hold the valve housing structure in position.

4. The containment valve assembly of claim 1, further comprising a heavy-duty doughnut-shaped expandable insert, seated in a space provided between the bottom of the stop flow plug and the lower annular base plate of the containment valve assembly, to provide additional pressure to drive the stop flow plug in the containment valve assembly to closure position, wherein the heavy-duty doughnut-shaped expandable insert expands to exert force against a bottom surface of the stop flow plug, when needed.

5. The containment valve assembly of claim 1, further comprising an annular expandable insert positioned to move the stop flow plug towards the closed position when needed.

6. The containment valve assembly of claim 1, further comprising an electronic component that senses any relevant data regarding the flow of the oil/gas.

7. A containment valve assembly for controlling flow of oil/gas under pressure through a riser pipe, the containment valve assembly comprising;

a valve housing structure having a riser seal for sealing against the riser pipe, and a socket cavity;

fasteners for fastening the valve housing structure to the riser pipe;

a stop flow plug that is shaped to fit within the socket cavity of the valve housing structure and that is driven against the socket cavity by the well's internal pressure from an open position wherein the oil/gas can flow between the stop flow plug and the valve housing structure, wherein the stop flow plug includes a conical shape nose for sealing against the socket cavity when in a closed position so that the oil/gas cannot flow between the stop flow plug and the valve housing structure; and at least one relief vent available that allow for escaping of oil and gas up through the containment valve assembly when the stop flow plug is in the open position, but which are sealed by the stop flow plug when in the closed position.

8. A containment valve assembly for controlling flow of oil/gas under pressure, through a riser pipe, the containment valve assembly comprising;

a stop flow plug that is driven to closure by the well's internal pressure, wherein the stop flow plug extends fully across the valve and downward into the valve to provide a means for stopping passage of oil/gas through the valve;

an inner shell structure profiling the stop flow plug to provide a cavity to capture the stop flow plug and extending downward to provide a base in the containment valve assembly to allow the well pressure to lift the stop flow plug to the stop flow position;

a valve housing structure having an upper sidewall extension on an upper end that encircles the valve housing structure, with a series of pilot holes to attach the valve housing structure to the riser pipe in order to hold the valve housing structure in position;

an upper close-out plate mounted on the valve housing, the upper close-out plate having a circular guide hole;

a plunger that extends from the stop flow plug through the circular guide hole, wherein the plunger is threaded for installing a nut that may be screwed down on the upper close-out plate for locking the plug in the closed position;

an electronic component that senses the pressure, the amount, density and temperature of the flow of oil/gas;

two or more relief vents available for escaping of oil and gas up through the containment valve assembly, wherein when the stop flow plug is in the full closure location, these passages are sealed by the stop flow plug; and a lower annular base plate with threaded holes for bolts for attachment to valve housing.

* * * * *